US010519608B2

(12) United States Patent
Coats et al.

(10) Patent No.: US 10,519,608 B2
(45) Date of Patent: Dec. 31, 2019

(54) METHOD AND APPARATUS FOR INSTALLING A RAIL ON A TIE IN A RAILROAD SYSTEM

(71) Applicant: Pandrol Limited, Surrey (GB)

(72) Inventors: Frank Howard Coats, Thorofare, NJ (US); David Tigue, West Deptford, NJ (US); Pelle Duong, Garnet Valley, PA (US)

(73) Assignee: PANDROL LIMITED, Surrey (GB)

( * ) Notice: Subject to any disclaimer, the term of this patent is extended or adjusted under 35 U.S.C. 154(b) by 209 days.

(21) Appl. No.: 15/676,742

(22) Filed: Aug. 14, 2017

(65) Prior Publication Data

US 2018/0127924 A1 May 10, 2018

Related U.S. Application Data

(60) Provisional application No. 62/374,410, filed on Aug. 12, 2016.

(51) Int. Cl.
*E01B 9/48* (2006.01)

(52) U.S. Cl.
CPC ..... *E01B 9/483* (2013.01)

(58) Field of Classification Search
CPC ..... E01B 9/483
See application file for complete search history.

(56) References Cited

U.S. PATENT DOCUMENTS

| | | | | |
|---|---|---|---|---|
| 3,970,248 | A * | 7/1976 | Molyneux | E01B 9/303 238/349 |
| 6,923,381 | B2 * | 8/2005 | Marshall | E01B 9/303 238/351 |
| 7,673,810 | B2 * | 3/2010 | Young | E01B 9/306 238/349 |
| 7,699,779 | B2 | 4/2010 | Young | |
| 8,499,695 | B1 | 8/2013 | Petkov | |
| 8,740,106 | B2 * | 6/2014 | Ryou | E01B 9/483 238/338 |
| 2009/0057435 | A1 * | 3/2009 | Igwemezie | E01B 9/483 238/349 |

(Continued)

FOREIGN PATENT DOCUMENTS

| | | |
|---|---|---|
| JP | 02-266001 | 10/1990 |
| TW | M299744 | 10/2006 |

(Continued)

OTHER PUBLICATIONS

E Type Elastic Rail Clip; Shanghai Wedo Industry CO.,LTD.; http://www.wedosteels.com/e-type-elastic-rail-clip_p34.html; Jun. 14, 2016.

(Continued)

*Primary Examiner* — Jason C Smith
(74) *Attorney, Agent, or Firm* — Gottlieb, Rackman & Reisman, PC

(57) ABSTRACT

A plate assembly for securing a rail to a tie that includes a clip and a shoulder with an orifice. At least one of the clip and the shoulder are modified by changing their respective shape to form a positive interference fit therebetween. The modification is provided to ensure that the clip is maintained with its leg partially inserted into the shoulder orifice during staging.

9 Claims, 8 Drawing Sheets

(56) References Cited

U.S. PATENT DOCUMENTS

| | | | | |
|---|---|---|---|---|
| 2012/0187208 | A1* | 7/2012 | Wang | E01B 9/303<br>238/351 |
| 2016/0305073 | A1* | 10/2016 | Coats | E01B 9/40 |
| 2018/0127924 | A1* | 5/2018 | Coats | E01B 9/483 |

FOREIGN PATENT DOCUMENTS

| | | |
|---|---|---|
| TW | 201114977 | 5/2011 |
| WO | 2014/000068 | 1/2014 |
| WO | 2014/118798 | 8/2014 |
| WO | 2014/177835 | 11/2014 |

OTHER PUBLICATIONS

"Gripping Task"; Railway Age; Mischa Wanek-Libman; Simmons-Boardman Publishing Inc.; http://www.railwayage.com/index.php/m_and_w/gripping-task.html; Feb. 28, 2014.

Track Accessories; A&K Railroad Materials, Inc.; http://www.akrailroad.com/products/track-accessories; Jun. 14, 2016.

PR401 Rail Clip; Kunshan Alex Railway Fastening Co., Ltd.; http://www.ksalex.com/tantiao/pro_show-32.html; Jun. 14, 2016.

* cited by examiner

METHOD AND APPARATUS FOR INSTALLING A RAIL ON A TIE IN A RAILROAD SYSTEM

CROSS-REFERENCE TO RELATED APPLICATIONS

This patent application claims benefit under 35 U.S.C. § 119 to U.S. Provisional Patent Application No. 62/374,410, filed Aug. 12, 2016, which is hereby incorporated by reference in its entirety as part of the present disclosure.

FIELD OF INVENTION

The present disclosure is directed to a rail system that includes a rail that is installed on or attached to a tie using a shoulder and a clip and more specifically to a rail system that includes a rail that is installed on or attached to a tie by a shoulder and clip wherein the center leg of the clip is maintained within the shoulder during staging.

BACKGROUND

Rails of a railroad system are typically supported on ties (made of wood, concrete, etc.) using plate assemblies. Each plate assembly normally may include, in sequence, a pad resting on a tie, a flat steel plate that has a sleeve-shaped shoulder resting on the pad, a clip and an insulator. The clip typically has two legs, is made of high-grade steel and acts as a spring forcing a foot or flange of the rail against the plate. This action ensures that the rail stays in position and does not move excessively as railroad cars pass over it.

For new installations, sections of track can be preassembled with the rails mounted on ties before the sections are laid. When tracks need repair or reconstruction, the various components discussed above must be assembled in the field. As part of this process, the clip is positioned manually with one of its legs extending partially into the shoulder. Once each pad assembly is positioned under the rail, the clip is pressed into position so that one of its legs passes through the sleeve and the other leg engages the rail. This step is performed either manually, with heavy hammers, or by using a pneumatic or hydraulic tool, which may be hand-held or vehicle-mounted. This whole process is called staging. An apparatus for performing staging is shown in U.S. Pat. No. 8,499,695.

A problem well-known in the field is that between the time the clip is positioned on the plate and the time that it is pressed into position to bias the rail against the plate, the clip is not restrained in any manner. Therefore, frequently the clip comes loose and separates from the plate. Once the clip moves out of place, it must be repositioned, thereby slowing down the staging. Moreover, any attempt made to press the clip into its final place when it is out of position may result in accidents and or damage to some of the other components of the plate assembly.

There have been attempts to resolve this problem in the past but by and large they were not successful.

SUMMARY OF THE INVENTION

The disclosure is directed to an assembly and a method of securing a rail, which has a rail foot, to a tie.

In an embodiment, the assembly includes a clip that has a first leg, a second leg, a section disposed between the first and second legs and a shoulder that has an orifice adapted to receive the first leg and a shoulder edge.

The clip has a first position in which the first leg is partially inserted into the orifice with the section disposed in contact with the edge and a second position in which the leg is fully inserted into the orifice and the clip abuts the rail foot.

Importantly, the section of the clip has a flat zone includes a planar surface arranged and sized to maintain the clip in the first position and prevent the clip from separating from the shoulder.

The clip can have circular cross-section except at the section.

The clip can form an interference fit with the shoulder in the first position.

In another embodiment, an assembly includes clip that has a first leg and a second leg and a section disposed between the first and second legs. The assembly further includes a shoulder that has an orifice adapted to receive the first leg and a shoulder edge. The clip has a first position in which the first leg is partially inserted into the orifice with the section being disposed in contact with the edge and a second position in which the leg is fully inserted into the orifice and the clip abuts the rail foot. The clip section is straight and is shaped and sized to form an interference fit with the shoulder to maintain the clip in said first position and prevent the clip from separating from the shoulder.

In another embodiment, the shoulder is formed with soft, plastic segments arranged and constructed to create an interference fit with the clip to maintain the clip in the first position and prevent the clip from separating from the shoulder.

DETAILED DESCRIPTION OF THE INVENTION

With reference now to the drawings, and in particular to FIGS. 1 through 7, embodiments for maintaining a clip temporarily engaged with the shoulder during the staging operation to ensure that the clip is positioned properly for engaging a rail will be described.

FIGS. 1A, 1B, 2A-2D show details of conventional rail assemblies in which a rail is supported on a tie includes a plate and/or pad, a shoulder, a clip and, optionally, an insulator.

Figure 1A:
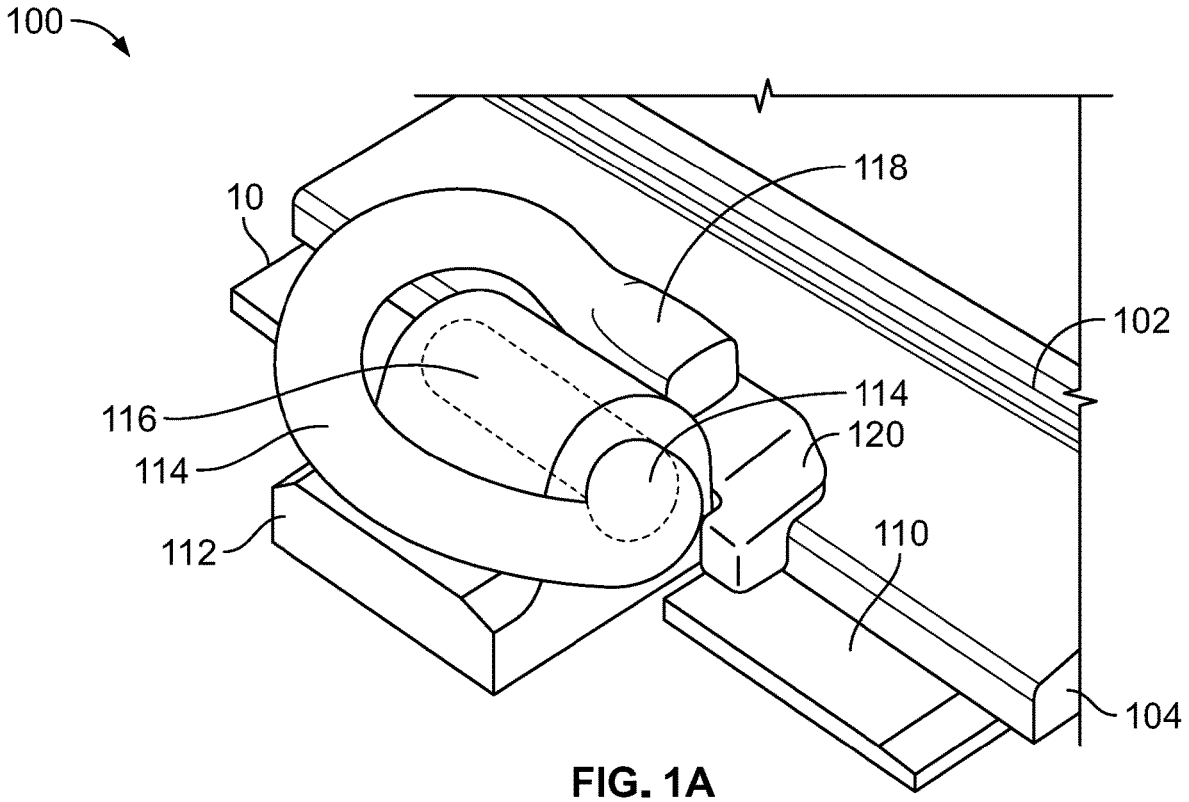
FIG. 1A (Prior Art)
FIGS. 1A and 1B are orthogonal views of two conventional plate assemblies using two different types of clips.

In FIG. 1A, an assembly 100 is used to attach a rail 102 that has a foot 104 to a tie (not shown). The assembly 100 includes a pad 110, a shoulder 112, a clip 114 with a center leg 116 and a toe 118 and an insulator 120. Once the assembly 100 is installed, the center leg 116 is seated inside the shoulder 112 and the toe 118 and an insulator 120 press the foot 104 of rail 102 downward and secure the rail 102.

Figure 1B:
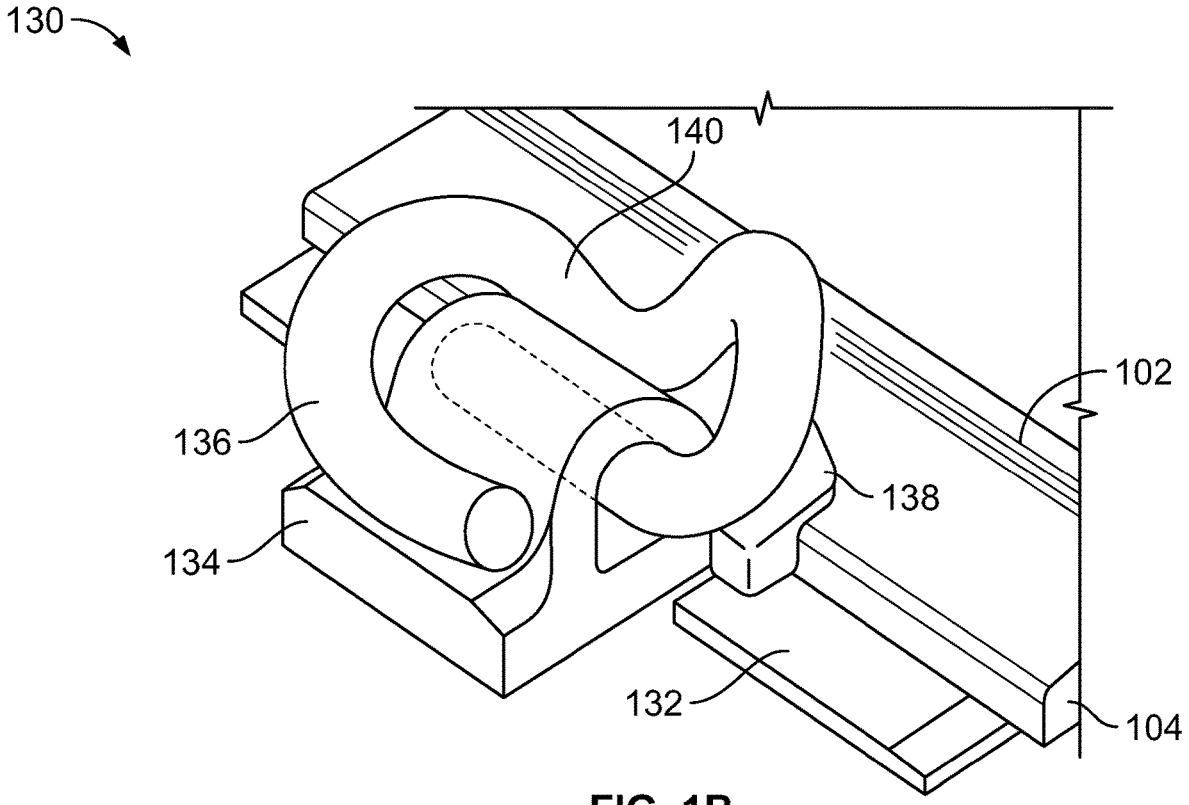
FIG. 1B (Prior Art)
Figure 2A:
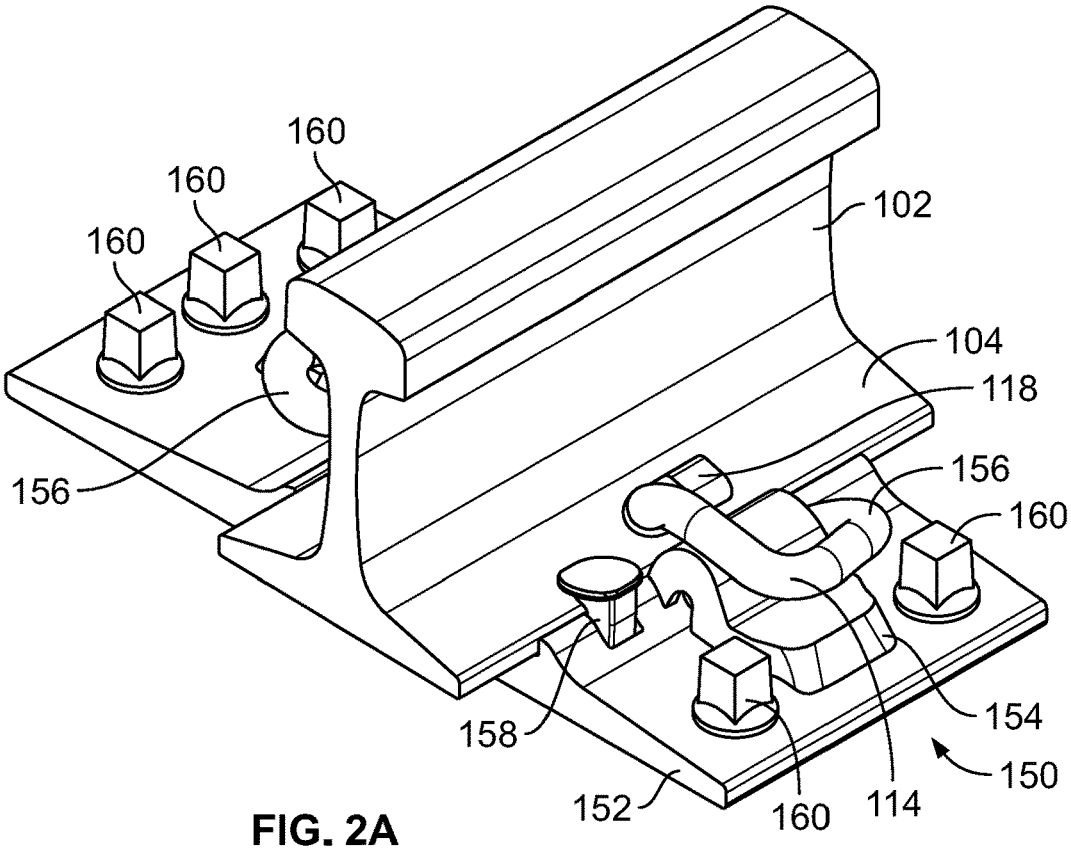
FIG. 2A (Prior Art)
FIGS. 2A-2D views showing a typical rail mounted on a tie using a plate and an e-type clip.
Figure 2B:
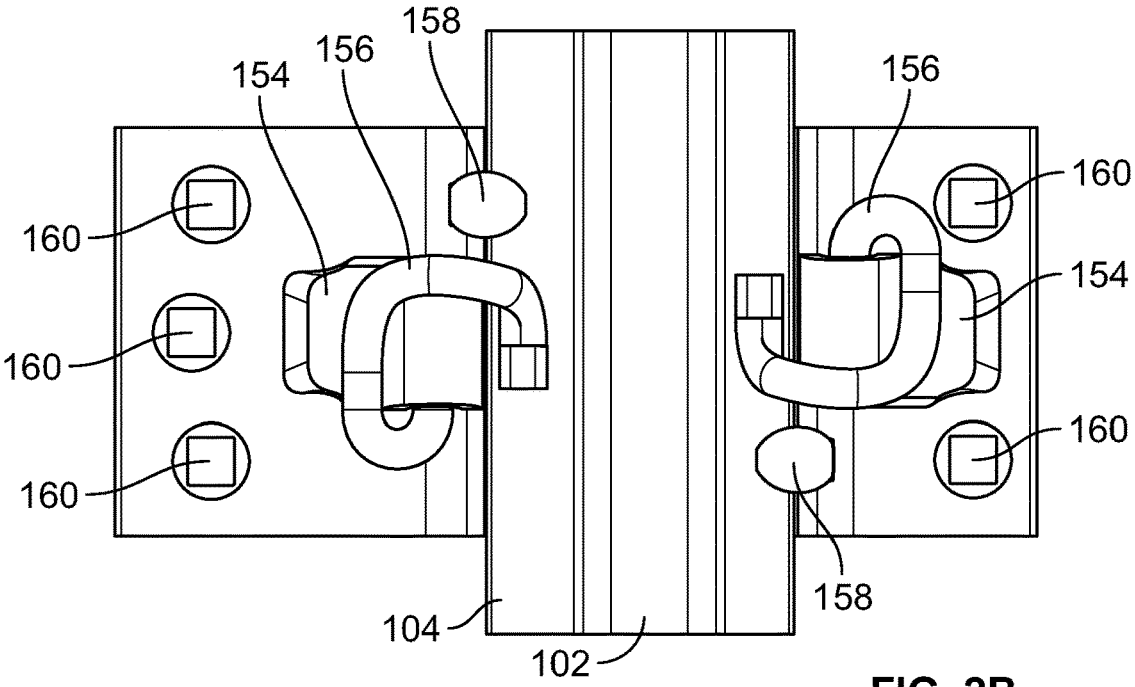
FIG. 2B (Prior Art)
Figure 2C:
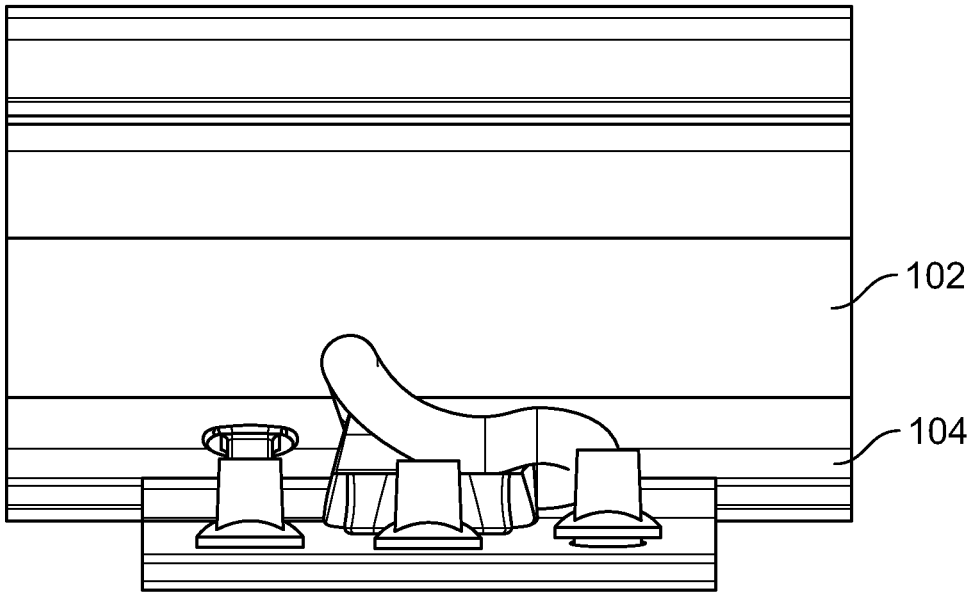
FIG. 2C (Prior Art)
Figure 2D:
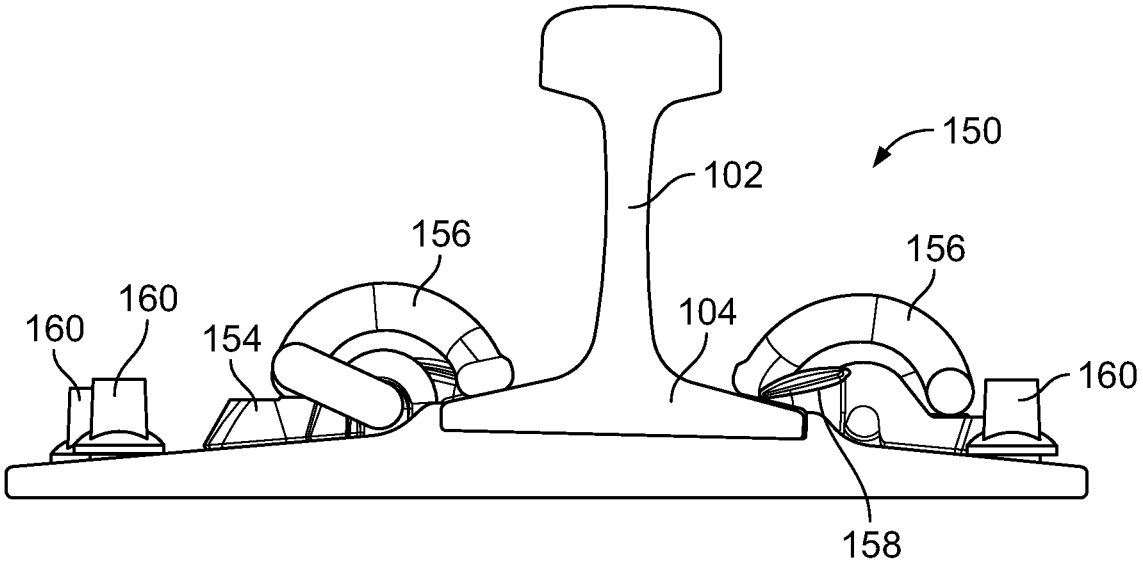
FIG. 2D (Prior Art)
Figure 3:
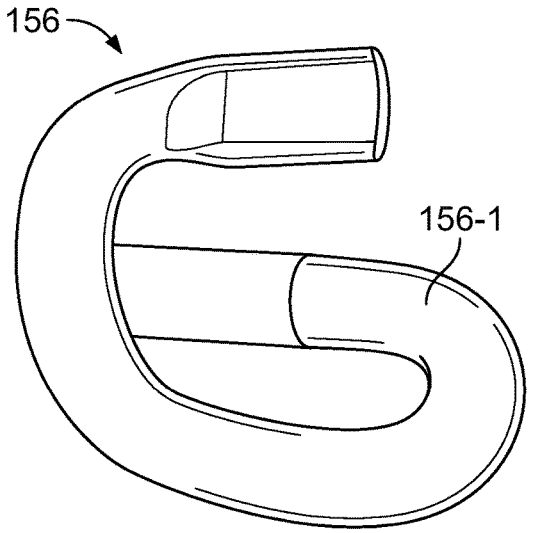
FIG. 3 (Prior Art)
FIG. 3 is a top perspective view of a conventional e-type clip used in the assembly of FIGS. 2A-2D.

FIG. 1B shows another assembly 130. The assembly 130, like assembly 100, has a pad 132, a shoulder 134, a clip 136 and an insulator 138. However, here, the clip 136 has an intermediate section 140 that is positioned to press down on the insulator 138.

FIGS. 2A-2D depict an assembly 150 that is similar to assembly 100. The assembly 150 includes a plate 102, a shoulder 154, and an e-shaped clip 156. Insulators are optional and have been omitted from the figures. The rail foot 104 is secured by spikes 158 and the plate 102 is secured by spikes 160.

Pursuant to embodiments of the present disclosure, components of a rail support assembly, such as those shown in FIGS. 1A-1B and 2A-2D have been modified to create an interference fit between the clip and the shoulder. The interference fit is sufficient to wedge and hold the clip in proper position with respect to the shoulder and its leg does not fall out of the shoulder.

Figure 4A:
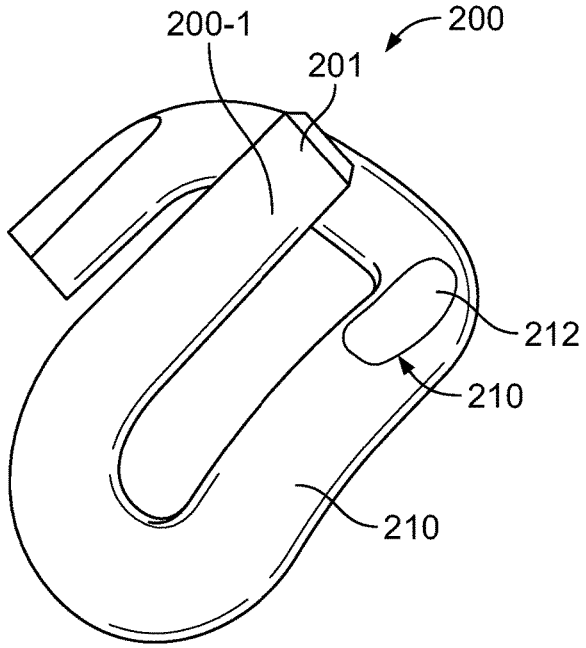
FIG. 4A (Prior Art)
FIG. 4A is a top view of an e-type clip with a flat area for temporarily engaging the shoulder of a plate assembly.
Figure 4B:
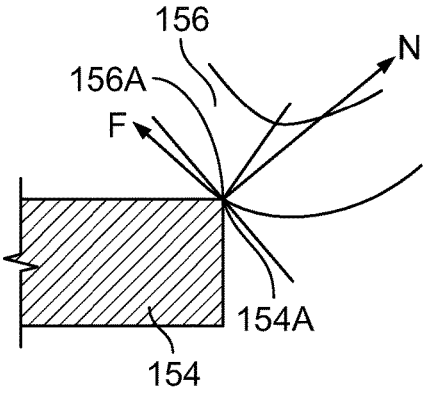
FIG. 4B (Prior Art)
FIG. 4B is a cross-sectional view of a shoulder and a conventional e-type clip resting on the shoulder prior to installation.
Figure 4C:
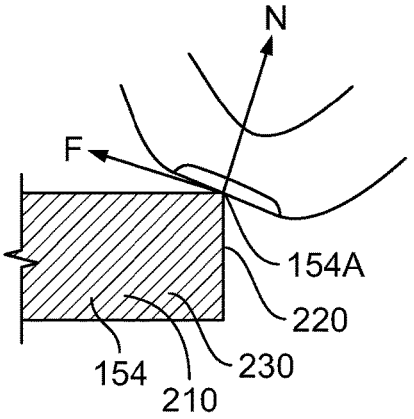
FIG. 4C is a cross-sectional view of a shoulder and the modified e-type clip is resting on the shoulder.
Figure 4D:
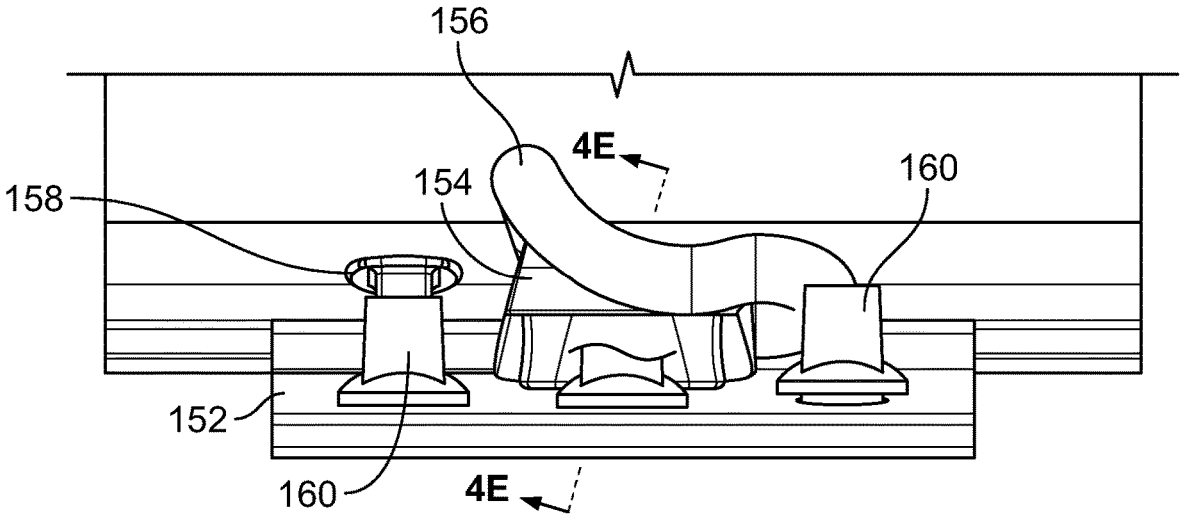
FIG. 4D (Prior Art)
FIG. 4D is a side view of a conventional assembly with an e-type clip.
Figure 4E:
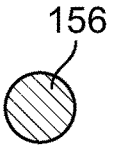
FIG. 4E (Prior Art)
FIG. 4E is a cross-sectional view of the clip of FIG. 4D taken along lines 4E-4E.

FIGS. 4B, 4D and 4E show the respective positions of the shoulder 154 and clip 156. In FIG. 4B, prior to the installation of the clip 156, the clip 156 is arranged such that a relatively small region or point 156A touches an edge 154A of the shoulder 154. FIG. 4E shows a cross-section of the clip 156 taken at the contact point with edge 154A. At the contact point, a friction force F is generated in the direction shown. Normally, the clip 156 is positioned so that its leg 156-1 is inserted into a hole of the shoulder 154 (not shown). The clip 156 is then released and a hammer or a pneumatic tool is used to push the clip 156 until it is fully seated (see FIG. 4D). It has been found that this force F may not sufficient to hold the clip 156 in place after the person releases it and therefore it may move out of place and even fall out.

In an embodiment, a portion of the clip is flattened to provide an interference fit. For example, as shown in FIG. 4A, a clip 200 includes a leg 201 and a section 210 (referred to as the heel seat) has at least one flattened portion defining a flat zone 212. When the leg 200-1 of the clip 200 is partially inserted into a shoulder hole (not shown), the flat zone 212 is disposed adjacent to the edge 154A of the shoulder 154. The actual contact between the clip 200 and the shoulder 154 occurs within the flat zone 212 as shown in FIG. 4A. Because of the orientation of the flat zone 212, any movement of the clip 200 away from the shoulder 154 is opposed by a frictional force F1. This force F1 is larger than force F and prevents the clip 200 from moving out of position.

Figure 4F:
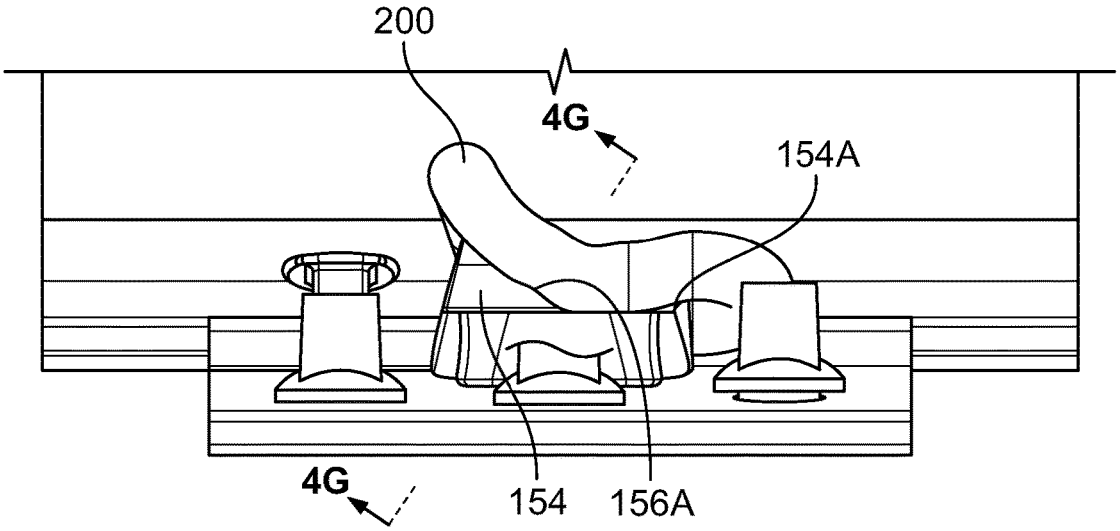
FIG. 4F is a side view of an assembly using the clip of FIG. 4A after installation.
Figure 4G:
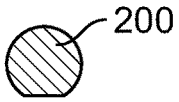
FIG. 4G is a cross-sectional view of the clip of FIG. 4F taken along line 4G-4G.

FIG. 4F shows the relative positions of the shoulder 154 and clip 200 after the clip 200 is installed. FIG. 4G shows a cross section of the clip 200 at zone 212.

Figure 5:
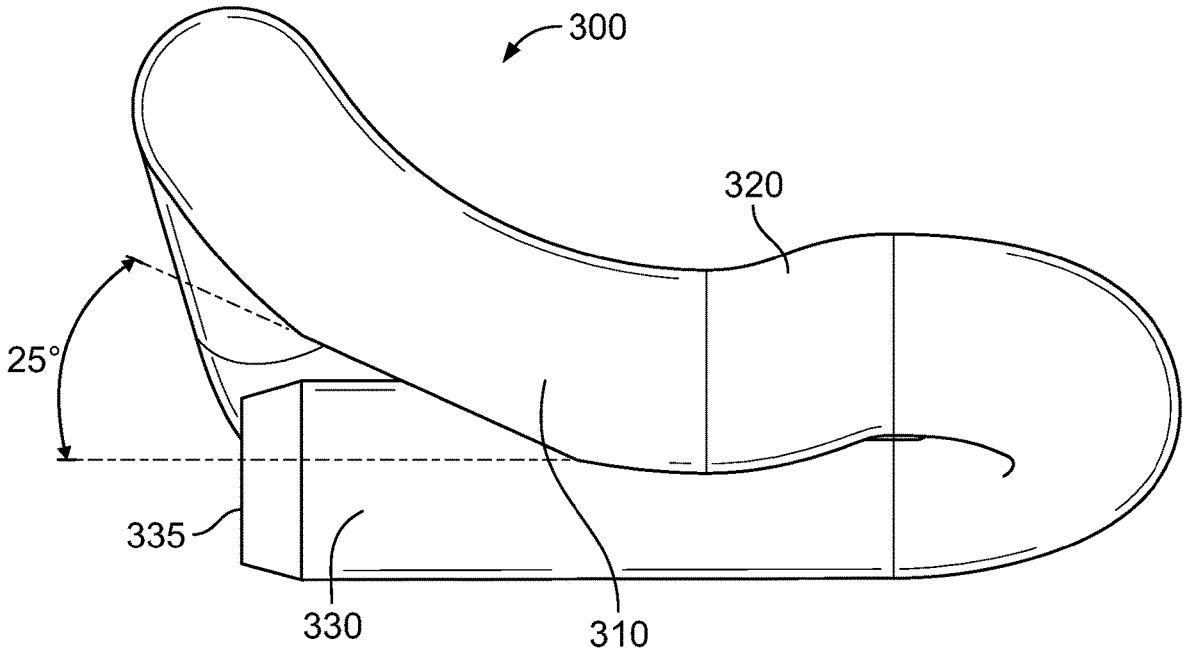
FIG. 5 is a side view of another embodiment of the present invention where a portion of an e-type clip is bent to form a straight section.
Figure 6A:
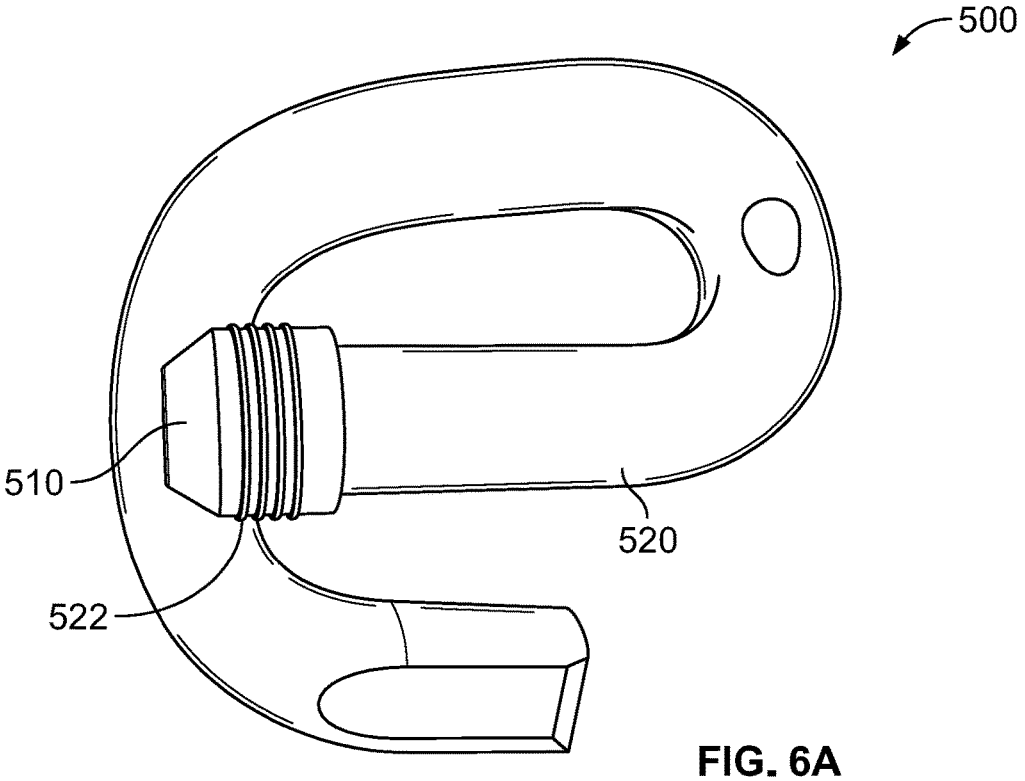
FIGS. 6A-6D are several views of another embodiment of the present invention where a cap is inserted on the central leg of an e-type clip.
Figure 6B:
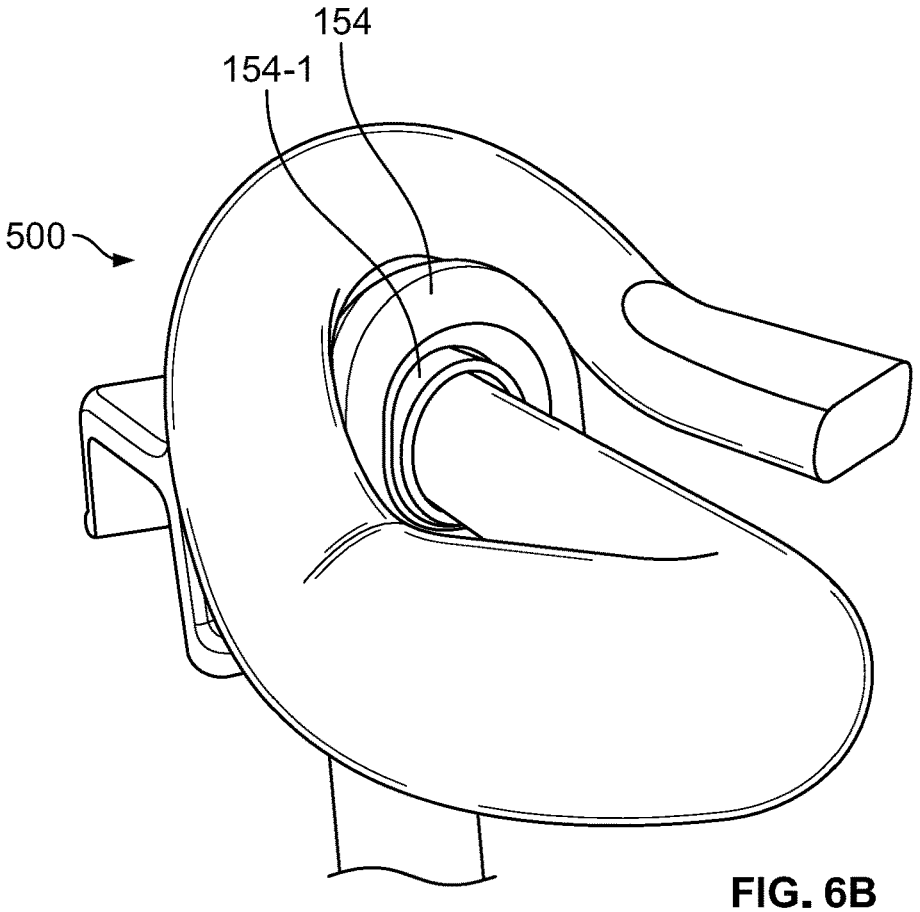
Figure 6C:
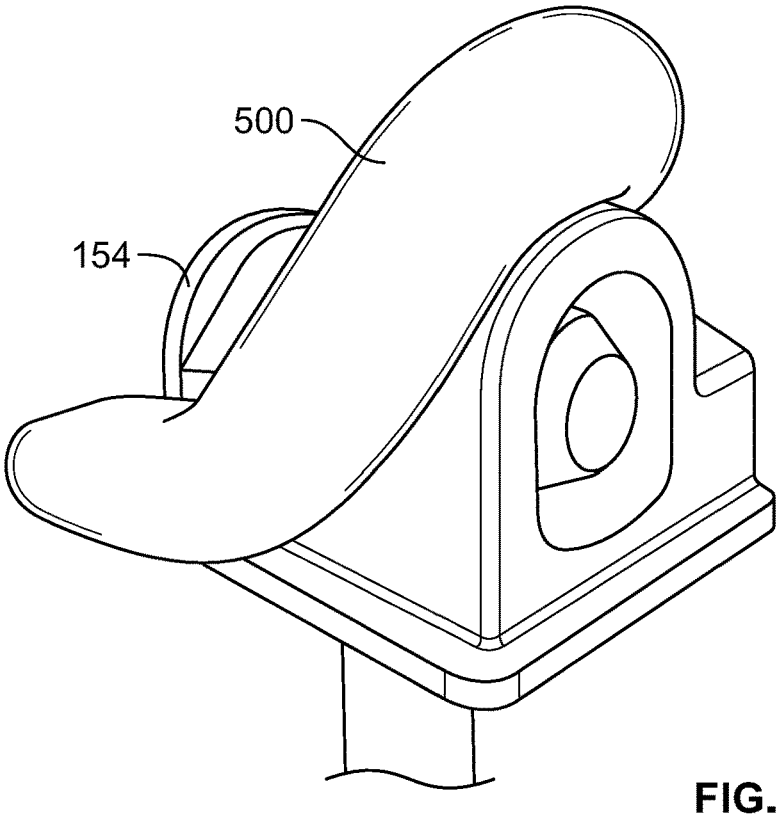
Figure 6D:
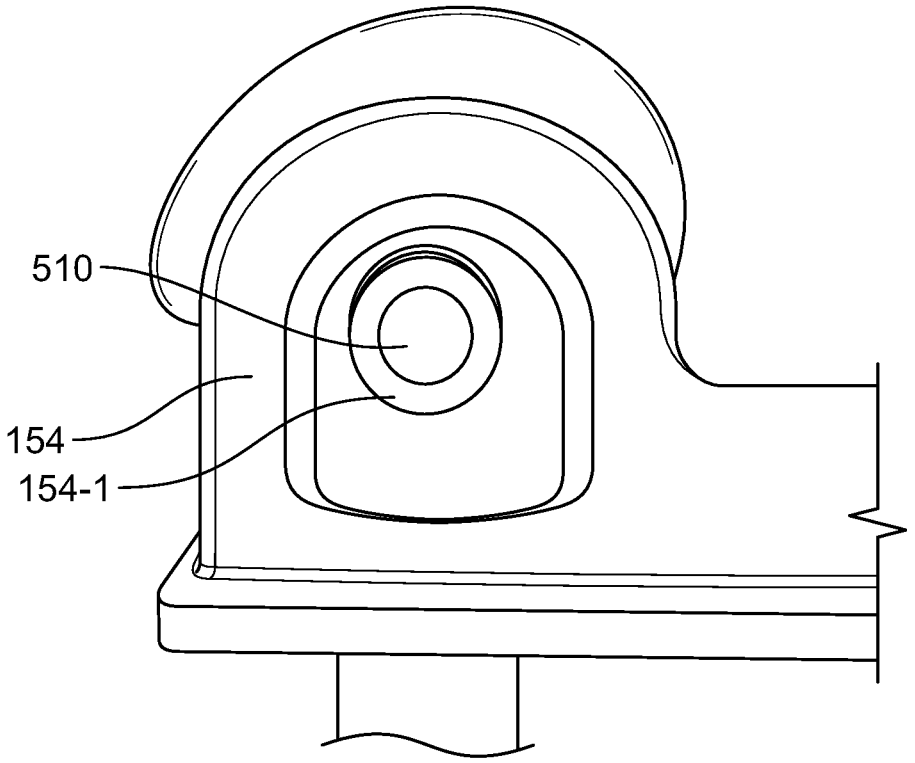

FIG. 5 shows another embodiment in which a plate assembly is provided with a clip 300. In this embodiment, clip includes a portion 310 on a heel 320 which is not curved (as in conventional clips) but is shaped so that it is linear for a distance of at least 18 mm and is disposed at an angle of about 25 degrees with respect to the center leg 330. As a result of this structure, when the clip 300 is positioned for staging, the heel 320 and the center leg 330 acts as a spring and grab the shoulder between them in a spring-like manner. As a result, the clip 300 will not fall out of the shoulder. Preferably, the center leg is chamfered as at 335 to facilitate inserting the center leg 330 into the shoulder orifice (not shown).

In another embodiment shown in FIGS. 6A-6D, a clip 500 is similar to clip 156 in FIGS. 2A-2D and is provided with a plastic cap 510 on the center leg 520. The cap 510 may be provided with several annular ribs 520 that engage the inner wall of the shoulder orifice 154-1 of shoulder 154 (See FIGS. 6B, 6C, 6D) and insure that the clip 500 does not fall out during staging. The cap 510 may be made by molding or other well-known techniques.

Figure 7:
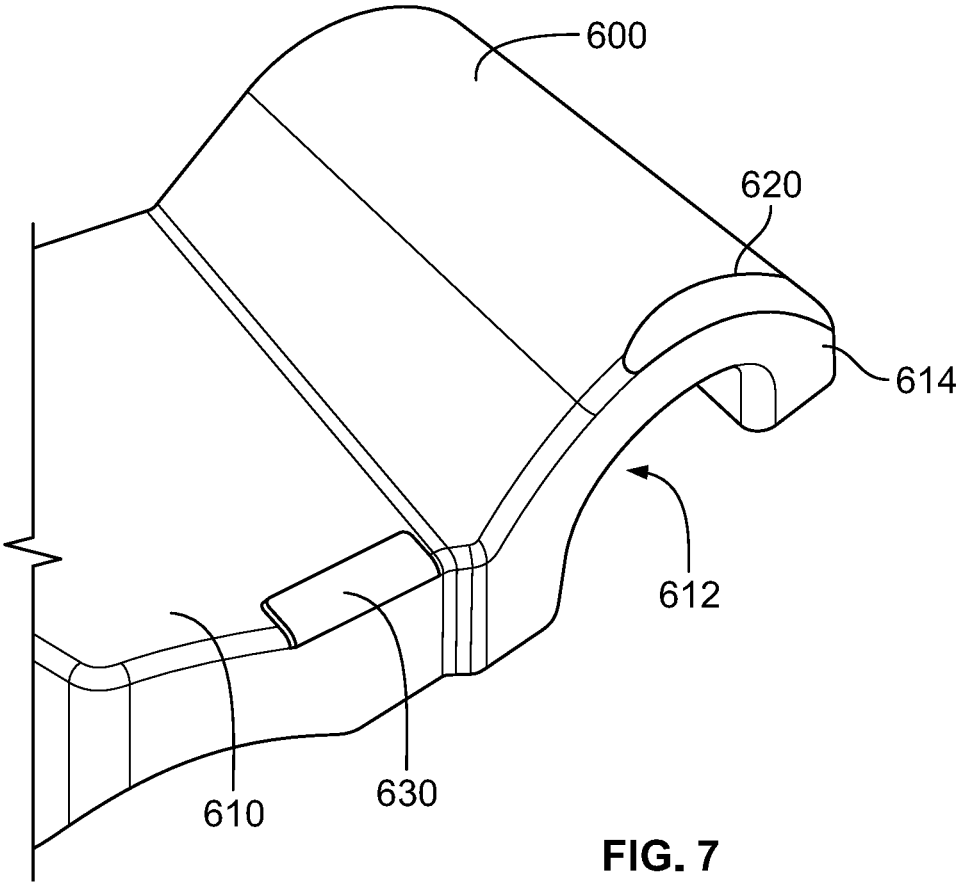
FIG. 7 is another embodiment of the present invention where the shoulder rather than a clip is modified.

In another embodiment shown in FIG. 7, instead of, or in addition to modifying the clip, a shoulder 600, similar to shoulder 154 is modified by adding, preferably elastomeric, material to the shoulder. Shoulder 600 includes an edge 610 and a sleeve 614 forming an orifice 612 for receiving the leg of a clip, such as clip 156. For example, the elastomeric material may be added on the sleeve 614 such as at 620. In addition, or instead, elastomeric material 630 may be added to the edge 610. These locations are selected to increase the frictional engagement between the shoulder and the relevant sections of the clip, such as its arch or heel seat. Instead of adding material, the shoulder itself may be cast with these additional elements selected to insure that the clip does not back out and fall off the shoulder.

In addition, to the techniques described above, other modifications may be made. For example, one or both of the shoulder and clip may be magnetized so they are kept together by a magnetic force therebetween.

Although the description above and accompanying drawings contains much specificity, the details provided should not be construed as limiting the scope of the embodiments, but merely as describing some of the features of the embodiments. The description and figures should not to be taken as restrictive and are understood as broad and general teachings in accordance with the present invention. While the embodiments have been described using specific terms, such description is for illustrative purposes only, and it is to be understood that modifications and variations to such embodiments, including, but not limited to, the substitutions of equivalent features and terminology may be readily apparent to those of skill in the art based upon this disclosure without departing from the spirit and scope of the invention.

What is claimed is:

1. An assembly securing a rail to a tie, the rail having a rail foot, the assembly comprising:

a clip having a first leg, a second leg and a heel disposed between the first leg and the second leg, the heel including portion extending linearly between the first leg and the second leg; and a shoulder having an orifice adapted to receive the first leg and a shoulder edge, wherein when the first leg is partially inserted into the orifice of the shoulder, the first leg and the heel are adapted to grip the shoulder between the first leg and the heel in a spring-like manner to secure the clip within the shoulder.

2. The assembly of claim 1, wherein the clip forms an interference fit with the shoulder when the first leg and the heel grip the shoulder.

3. An assembly securing a rail to a tie, the rail having a rail foot, the assembly comprising:

a clip haying a first leg, a second leg and a section disposed between the first leg and the second leg, the section includes a heel having a portion thereof extending straight between the first leg and the second leg; and a shoulder having an orifice adapted to receive the first leg and a shoulder edge, wherein, in a first position, the first leg is partially inserted into the orifice and the heel is disposed in contact with the shoulder edge and, in a second position, the first leg is fully inserted into the orifice and the clip abuts the rail foot, and wherein the straight section of the heel is shaped and sized to form an interference fit with the shoulder to maintain the clip in said first position and prevent the clip from separating from the shoulder.

4. An assembly securing a rail to a tie, the rail having a rail foot, the assembly comprising:

a clip having a first leg, a second leg and a section disposed between the first leg and second leg, the section includes a heel having portion extending linearly between the first leg and the second leg; and a shoulder having an orifice adapted to receive the first leg and a shoulder edge, wherein, in a first position, the first leg is partially inserted into the orifice of the shoulder with the first leg and heel adapted to grip the shoulder between the first leg and the heel in a spring-like manner to secure the clip within the shoulder and, in a second position, the first leg is fully inserted into the orifice and the clip abuts the rail foot, and wherein the shoulder has a section made of plastic material that is arranged and constructed to form an interference fit with the clip to maintain the clip in the first position and prevent the clip from separating from the shoulder.

5. The assembly of claim 1, Wherein the heel extends linearly for at least 11 mm.

6. The assembly of claim 1, wherein the portion of the heel extending linearly is disposed at an angle of about 25 degrees with respect to the first leg.

7. The assembly of claim 1, wherein the first leg is chamfered at a distal end to facilitate inserting the first leg into the orifice of the shoulder.

8. The assembly of claim 1, further comprising a cap extending over a distal end of the first leg.

9. The assembly of claim 8, wherein the cap includes a plurality of annular ribs that are configured to engage an inner wall of the orifice of the shoulder.

* * * * *